US006272998B1

(12) United States Patent
Strandli

(10) Patent No.: US 6,272,998 B1
(45) Date of Patent: Aug. 14, 2001

(54) PROJECTILE WITH A TRACER SLEEVE HAVING A SELF-DESTRUCTION CHARGE

(75) Inventor: Kåre R. Strandli, Tønsberg (NO)

(73) Assignee: Nammo Raufoss AS, Raufoss (NO)

( * ) Notice: Subject to any disclaimer, the term of this patent is extended or adjusted under 35 U.S.C. 154(b) by 0 days.

(21) Appl. No.: 09/375,442

(22) Filed: Aug. 17, 1999

(30) Foreign Application Priority Data

Aug. 17, 1998 (NO) ..... 19983761

(51) Int. Cl.[7] ..... F42B 12/38
(52) U.S. Cl. ..... 102/513; 102/473
(58) Field of Search ..... 102/473, 490, 102/513

(56) References Cited

U.S. PATENT DOCUMENTS 1,518,247 * 12/1924 Brayton ..... 102/513
2,093,353 * 9/1937 Gertmann ..... 102/513
2,296,901 * 9/1942 Brayton ..... 102/513
2,530,934 * 11/1950 Barton et al. ..... 102/513
3,494,285 * 2/1970 Doris, Jr. et al. ..... 102/513
3,677,181 * 7/1972 Giljarhus et al. ..... 102/364
4,553,482 * 11/1985 Weber et al. ..... 102/529

FOREIGN PATENT DOCUMENTS

411381 * 6/1934 (GB) ..... 102/513
6701593 * 8/1967 (NL) ..... 102/473

* cited by examiner

*Primary Examiner*—Harold J. Tudor
(74) *Attorney, Agent, or Firm*—Bacon & Thomas, PLLC

(57) ABSTRACT

A tracer sleeve having a self-destruction charge, for use with a projectile. The tracer sleeve is screwed into a threaded bore in a rearward end of the projectile. The self-destruction charge is situated in a recess in a forward bottom of the tracer sleeve. A closed bushing bottom in the projectile separates the bore from a more forwardly situated charge member. The recess being a blind bore from the front side of the bottom of the tracer sleeve, and the blind bore being closed by a disc which is sealingly attached in front of the blind bore.

2 Claims, 1 Drawing Sheet

PROJECTILE WITH A TRACER SLEEVE HAVING A SELF-DESTRUCTION CHARGE

BACKGROUND OF THE INVENTION

1. Field of the Invention

The present invention relates to a tracer sleeve having a self-destruction charge, for a projectile, and being adapted to be screwed into a threaded bore in the rearward end of the projectile. The self-destruction charge being situated in a recess in a forward bottom of the tracer sleeve.

2. Description of the Related Art

It is known to place a self-destructive charge in a separate sleeve or capsule, which is screwed into the forward end of a tracer sleeve. During launching of the projectile by use of a propellant charge, which acts against the rear end of the projectile, there is a danger that gases from the propellant charge may flow forwardly to the self-destruction charge, through the thread connection between the tracer sleeve and the projectile bushing. This brings about the danger that the self-destruction charge may be ignited, whereby the remaining charges in the projectile react and the projectile bursts. This will normally only happen if the projectile continues in its trajectory beyond a predetermined time, for instance when the projectile misses a target, whereby the development of heat in the tracer charge causes ignition of the self 20 destruction charge.

SUMMARY OF THE INVENTION

With a tracer sleeve according to the invention, the possibility of unintentional ignition of the self-destruction charge caused by gases from the propellant charge flowing forwardly to the self-destruction charge is avoided.

According to the invention a bushing bottom in the projectile separates the bore from a more forwardly situated charge chamber, the recess being a blind bore from the forward of the bottom of the tracer sleeve, and the blind bore being closed by a disc which is sealingly attached in front of the blind bore. Thereby, it is not possible for gases developed by the propellant to pass along the threads connecting the tracer sleeve and the projectile bushing to enter the blind bore in which the self-destruction charge is situated. In order that the self-destruction charge may function in the normal manner, there is no need for forming a throughgoing hole in the bushing bottom ion front of the blind bore, because the bottom of the bushing in front of the blind bore is formed by a wall having such a strength that the wall bursts when the self-destruction charge is fired, whereby the charge may cause ignition of one or more main charges (incendiary and/or explosive charges) further forwardly in the projectile.

The invention also provides a solution for another problem related to projectiles which are stored for a long time. A tracer charge normally has a shorter maximum storagetime (10–15 years) than the remainder of, for instance a grenade (25–30 years). Thus, replacement of the tracer charge and a self-destruction charge may therefore be of interest for storing beyond these 10–15 years. When a tracer retainer according to conventional practice is in direct contact with a bursting charge in a projectile, unscrewing of the tracer retainer entails that the bursting charge is exposed. The bursting charge will usually have been pressed against the tracer retainer, because a tight contact of the bursting charge against the tracer retainer is essential in order to avoid "setback" due to inertia forces during launching. However, when a new tracer retainer is screwed in during replacement, the length of the retainer lies within certain tolerances, and there is a possibility that a slit is formed between the bursting charge and the new retainer. The projectile may, therefore, be dangerous to launch, because an adiabatic heating of the bursting charge may occur in the slit area. Measures for avoiding such a slit consist of placing discs ("shims") for filling the slit, but this must be combined with X-ray checking in order to ascertain whether the slit is actually filled. Replacement of the tracer charge, therefore, is complicated.

The present invention discloses that a bursting charge in front of the tracer charge and the self-destruction charge is pressed in against a fixed bottom in the projectile bushing, and is thus not influenced by a replacement of the tracer charge.

The invention will be described in a more detailed manner in the following, with reference to the accompanying drawing, showing an example of an embodiment of the invention.

DETAILED DESCRIPTION OF A PREFERRED EMBODIMENT

Figure 1:
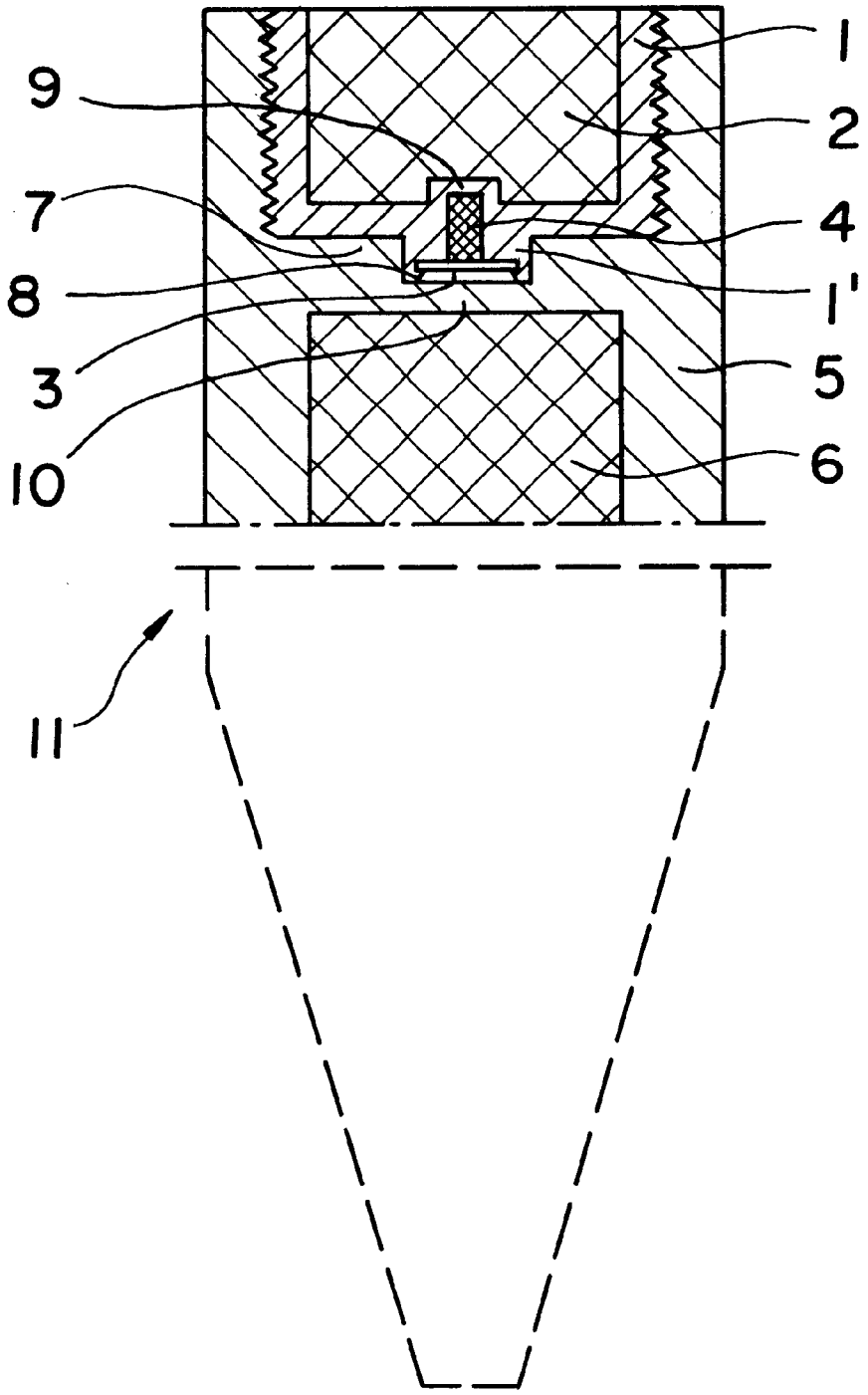
FIG. 1 shows a longitudinal section through the rear end of a projectile comprising a tracer sleeve according to the invention, and also shows the projectile having a bursting charge situated in a projectile bushing in front of the tracer sleeve.

FIG. 1 shows a tracer sleeve 1 mounted in a hole in the rear end of a projectile bushing 5, of which the rear end is shown. A recess which contains a self-destruction charge 4 forms a blind bore in the forward bottom of the tracer sleeve 1. The blind bore as such is open in the forward end, which after filling of the self-destruction charge is sealingly closed by a disc 3. The tracer sleeve 1 has a forward extension 1' and a rearward extension 9, between which the blind bore is situated, and the separator bottom 7 of the bushing 5 has a corresponding recess adapted to receive the forward extension 1'. The tracer sleeve 1 is filled with a tracer charge 2 which is ignited by the propellant charge set off at the launching of the projectile 11. If the projectile 11 hits a target and exerts an explosive and/or incendiary effect in the target, the self-destruction charge 4 will not have any other effect than being fired together with the remaining charges in the projectile. However, if the projectile 11 does not hit any target within a certain period of time after the launching of the projectile 11, the self-destructive charge 4 will become sufficiently heated by the combustion of the tracer charge 2 such that the self destruction charge will detonate, whereby the disc 3 loosens from its position or bursts causing the separator bottom 10 of the recess in the separator bottom 7 of the bushing 5 to burst and cause an ignition of charges that are positioned more forwardly in the bushing 5, such as the main charge 6. Thus, the projectile 11 will explode in its trajectory when it fails to hit a target, after a certain period of time. Instead of or in addition to charges, the bushing 5 may contain a penetrator.

The tracer sleeve 1 is screwed into the bushing 5, and, thus, it is replaceable. During the launching of the projectile 11 from a weapon, such as a gun barrel, gas under a high pressure will be developed by the ignition of the propellant charge, and the gas may possibly pass along the threads which connect the tracer sleeve 1 and the bushing 5. The gas, however, will not reach the self-destruction charge 4, because the blind bore is sealingly closed by the disc 3. Therefore, there is no danger that the gas may ignite this charge. Such ignition is of course very dangerous, as it may cause firing of all the charges in the projectile 11 inside a weapon barrel or when the projectile 11 is immediately outside such a barrel.

Several possibilities for the attachment of the disc 3 in front of the blind hole containing the charge 4 are possible. In the embodiment shown, a shallow bore is formed, having an axial length, being somewhat larger than the thickness of the disc 3, in a forward extension 1' of the bottom of the sleeve 1, and upon the insertion of the disc 3, the edge 8 of the bore is deformed radially inwardly, on the outside of the disc 3.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed:

1. A projectile comprising:

front and rear ends;

a threaded rear bore;

a main charge positioned between the rear bore and the front end;

a closed separator bottom positioned between the rear bore and the main charge which separates the main charge from the rear bore;

a tracer sleeve with a closed bottom, the tracer sleeve comprising a cylindrical threaded outer surface threadably engaged to the threaded rear bore of the projectile;

a tracer charge positioned in the tracer sleeve;

a blind bore positioned in a forward extension of the closed bottom of the tracer sleeve, the blind bore having a single opening which faces the closed separator bottom of the projectile;

a self-destruction charge located in the blind bore; and a disc secured onto the single opening of the blind bore to close off the blind bore.

2. The projectile according to claim 1, wherein the closed bottom of the tracer sleeve further comprises a rearward extension, and the blind bore is positioned in the forward and rearward extensions.

* * * * *